US006174250B1

(12) United States Patent
Hollis et al.

(10) Patent No.: US 6,174,250 B1
(45) Date of Patent: Jan. 16, 2001

(54) THROWING TOY HAVING LOOPED FILAMENTS AND CATCHING DEVICE THEREFOR

(75) Inventors: John R. Hollis, Topanga; John L. Cook, Redondo Beach, both of CA (US)

(73) Assignee: OddzOn, Inc., Napa, CA (US)

( * ) Notice: Under 35 U.S.C. 154(b), the term of this patent shall be extended for 0 days.

(21) Appl. No.: 09/133,021

(22) Filed: Aug. 12, 1998

Related U.S. Application Data

(60) Provisional application No. 60/025,920, filed on Sep. 11, 1996, and provisional application No. 60/027,673, filed on Oct. 7, 1996.

(51) Int. Cl.[7] ..... A63B 67/00

(52) U.S. Cl. ..... 473/573; 473/514; 473/503

(58) Field of Search ..... 473/503, 514, 473/573, 614; 273/348.4, DIG. 30

(56) References Cited

U.S. PATENT DOCUMENTS

| | | | | |
|---|---|---|---|---|
| Re. 34,461 | | 11/1993 | Buselli . | |
| 3,949,989 | | 4/1976 | Van Meter | 473/348.4 |
| 3,953,030 | | 4/1976 | Muchnick | 473/573 |
| 3,999,748 | | 12/1976 | Clarke | 473/573 |
| 4,415,154 | | 11/1983 | Engelhardt . | |
| 4,756,529 | * | 7/1988 | Stillinger | 473/614 |
| 4,789,161 | | 12/1988 | Waskelo | 473/573 |
| 4,836,554 | | 6/1989 | Robbins . | |
| 4,875,689 | | 10/1989 | Lin . | |
| 4,962,926 | | 10/1990 | Chen | 473/614 |
| 4,971,334 | | 11/1990 | Stewart . | |
| 4,995,617 | | 2/1991 | Lee | 473/348.4 |
| 5,082,291 | | 1/1992 | Appel et al. . | |
| 5,100,152 | | 3/1992 | Butler, III | 473/573 |
| 5,165,684 | | 11/1992 | Pratt . | |
| 5,199,716 | | 4/1993 | DeFluiter et al. . | |
| 5,203,572 | * | 4/1993 | Lirn | 273/348.4 |
| 5,253,874 | * | 10/1993 | Hoffman | 473/514 |
| 5,316,311 | | 5/1994 | Lee | 473/348.4 |
| 5,324,042 | | 6/1994 | Demas . | |
| 5,335,916 | | 8/1994 | Nee . | |
| 5,362,066 | | 11/1994 | Sassak | 473/573 |
| 5,516,099 | | 5/1996 | Strong | 473/614 |

* cited by examiner

*Primary Examiner*—Steven Wong
(74) *Attorney, Agent, or Firm*—Kolisch Hartwell Dickinson McCormack & Heuser

(57) ABSTRACT

A catching device for releasably catching a throwing toy is provided with bristles which can hold the throwing toy on contact even under conditions of high velocity and low-grazing angle of impact. The throwing toy has a plurality of looped filaments, joined at a core region by a wire cinch. The filaments radiate in plural angularly offset planes in a dense, bushy configuration from the core region. The catching device includes a base with a generally convex front outer surface and configured to be held adjacent a user's hand. A plurality of bristles are attached to the base, each having a proximal end adjacent the base and extending from the base to a distal end opposite the proximal end. The bristles are substantially straight from the proximal end to the distal end and are configured to catch the toy when the toy is thrown into contact with the bristles and to hold the toy on contact by engaging the looped filaments of the toy. Each bristle includes a generally enlarged head and the bristles cooperate with the toy to dissipate the toy's kinetic energy to prevent the toy from bouncing off the device.

16 Claims, 6 Drawing Sheets

FIG. 7
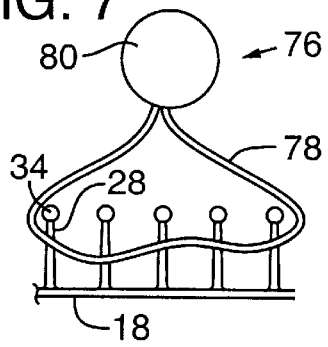
FIG. 8
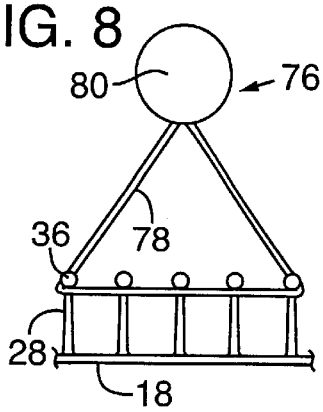
FIG. 9
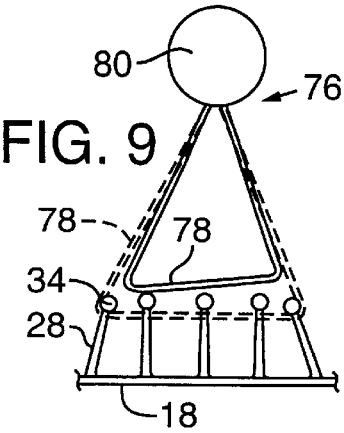
FIG. 10
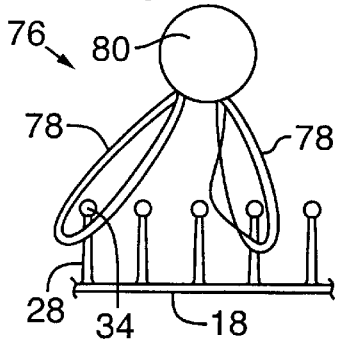
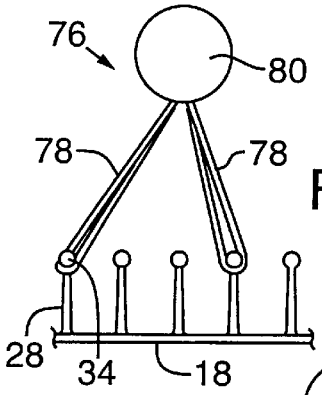
FIG. 11
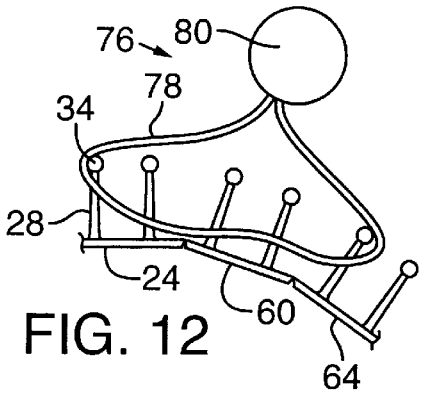
FIG. 12
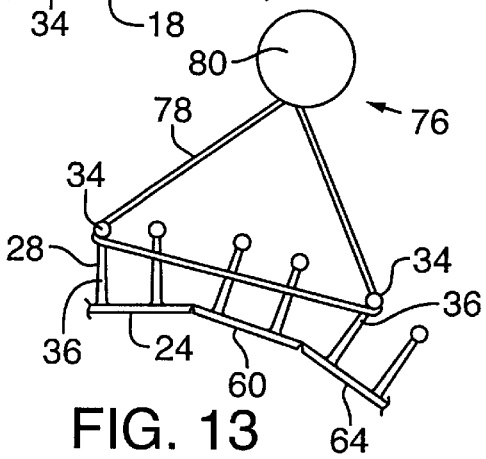
FIG. 13
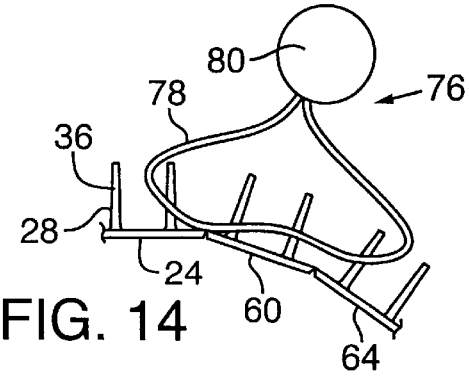
FIG. 14
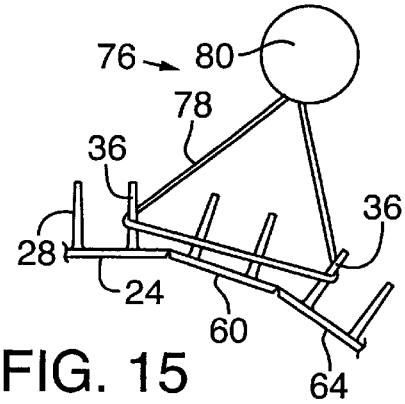
FIG. 15

THROWING TOY HAVING LOOPED FILAMENTS AND CATCHING DEVICE THEREFOR

This application is based upon and claims the benefit under 35 U.S.C. § 120 of a U.S. patent application Ser. No. 08/927,698, entitled THROWING TOY HAVING LOOPED FILAMENTS AND CATCHING DEVICE THEREFOR, filed Sep. 11, 1997, which is incorporated by reference, and which claims the benefit under 35 U.S.C. § 119 of the following prior-filed U.S. Provisional Patent Applications, each incorporated herein by reference: Ser. No. 60/025,920, entitled CATCHING DEVICE FOR OBJECTS HAVING LOOPED FILAMENTS, filed Sep. 11, 1996 and Ser. No. 60/027,673, entitled PROJECTILE DEVICE HAVING LOOPED FILAMENTS, filed Oct. 7, 1996.

BACKGROUND AND SUMMARY OF THE INVENTION

This invention relates to a throwing toy and a catching device for the toy, and in particular to a throwing toy formed of elastic, looped filaments, cinched together at a central area and spreading outwardly generally in a ball-shape, and a catching device having an array of upstanding, enlarged-headed bristles configured to receive and capture the looped filaments while dissipating the kinetic energy of the toy when thrown, thus securing the toy to the catching device even when the toy is thrown at a high velocity. The bristles will also capture and secure the toy when it is thrown at a very low grazing angle. The toy is captured and secured by the looped filaments' intertwining around and being engaged by the bristles, typically with many of the looped filaments extending around two or more bristles and with the looped filaments extending around widely separated bristles, so that the toy is retained on the catching device.

The throwing toy may alternatively have a head of elastic, looped filaments attached to a fmned tail section, for an overall shape of a dart or rocket. The dart- or rocket-shaped toy is weighted so that the looped-filament head generally stays forward when the toy is thrown and the catching device receives and captures the looped filaments as for the ball shape.

Systems have been designed in the past using hook-and-loop fasteners, such as those sold under the trademark VELCRO, with the hooks or loops provided on a ball and the complementary fasteners provided on a catching mitt. However, when such systems are used, the ball tends to bounce off of the mitt when thrown at a high speed, or to glance off the mitt when thrown at a low grazing angle to the mitt. Such systems as that shown in U.S. Pat. No. 5,085,442 attempt to solve the problem of failed retention of the ball by the mitt by providing layers of padding to dissipate the ball's energy. Such solutions do nothing to help catch the ball when thrown at a low grazing angle and still allow the ball to bounce off if thrown at a high enough speed.

DESCRIPTION OF THE DRAWINGS

FIG. 7 is a partial view of the catching device and the throwing toy having the ball-shape, showing a single elastic, looped filament attached to a schematic representation of the center of mass of the throwing toy and five spherical-headed bristles being looped by the filament as the toy comes into contact with the catching device.

FIG. 8 is the partial view of FIG. 7 showing how the filament is held by the heads of the bristles about which the filament is looped, thus retaining the toy on the catching device.

FIG. 9 is the partial view of FIG. 7 showing removal of the toy where a force exerted on the toy in a direction away from the catching device stretches the filament and bends the bristles until the filament slips over the heads.

FIG. 10 is a partial view of the catching device and the throwing toy, similar to FIG. 7, but showing two looped filaments as the ball comes into contact with the catching device and the filaments loop around two bristles.

FIG. 11 is the partial view of FIG. 10 showing how the filaments are retained by the heads of the bristles, thus holding the toy on the catching device.

FIG. 12 is a partial view of the catching device and throwing toy, similar to FIG. 7, but showing a filament looping over two bristles that are splayed apart because they extend perpendicularly from segments of the catching device that are joined in an angled relationship.

FIG. 13 is the partial view of FIG. 12 showing how the splaying of the bristles increases the force required to remove the toy from the catching device.

FIG. 14 is a partial view of the throwing toy and an alternative embodiment of the catching device with bristles having no heads.

FIG. 15 is the partial view of FIG. 14 showing how the splaying of the bristles allows retention of the toy despite the lack of heads.

DETAILED DESCRIPTION OF THE INVENTION

Figure 1:
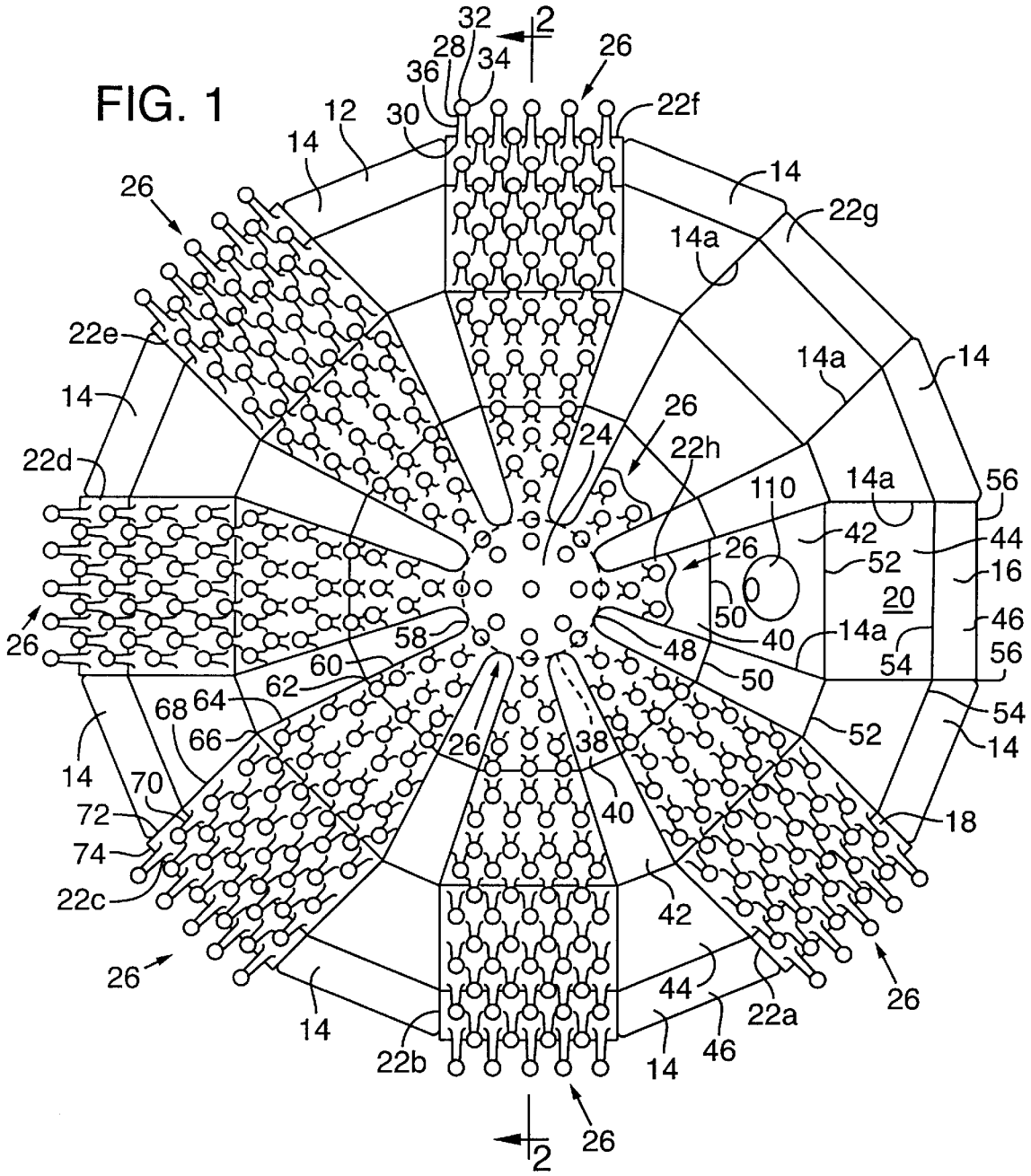
FIG. 1 is a plan view of the catching device of the present invention showing an array of bristles or spines attached to a pad having eight radially extending arms, on one of which the bristles are cut away to show the pad, the pad being attached to a base configured to be held adjacent a user's hand, and one of the pad arms is shown partially cut away to illustrate the base beneath the pad.

As shown in FIG. 1, a catching device according to the present invention is indicated generally at 10. Device 10 includes a base, such as molded plastic housing 12, which is generally circular in shape and is formed with alternating raised and recessed wedge-shaped portions, such as eight raised portions 14 and eight recessed portions 16 (one of which is visible in FIG. 1), defined by sixteen walls 14*a* connecting each raised portion to the adjacent recessed portion. One of walls 14*a* can best be seen in FIG. 3 between one of raised portions 14 and one of recessed portions 16.

As best seen in FIG. 1, a molded plastic pad, such as spine pad 18, is attached to a front surface 20 of housing 12. Pad 18 is formed with eight segmented pad arms 22*a–h* extending radially outward from a pad center 24 (pad arm 22*h* being shown mostly cut away to expose one of the recessed portions 16 of housing 12). The pad arms increase in width from a relatively narrow end adjacent the pad center to a broader opposite end. Pad center 24 and each of pad arms 22*a–h* includes an array 26 of bristles 28 extending outwardly and generally perpendicularly from pad 18 (pad arm 22*g* being shown with most of array 26 cut away to expose the pad arm). As shown in FIG. 1, bristles 28 are typically arrayed in a concentration of about twelve to twenty per square inch but a higher or lower concentration may be used.

Each bristle 28 includes a proximal end 30 affixed to pad 18, a distal end 32 opposite the proximal end with a generally enlarged, spherical head, such as knob 34, and a stalk 36 interconnecting the proximal and distal ends. Each bristle 28 is preferably nominally substantially straight from its proximal end to its distal end, but alternatively may be formed in a bent, coiled, or other non-straight configuration, such as having a hooked distal end.

As shown in FIG. 1, front surface 20 of housing 12 has five concentric, generally circular regions: a first, innermost, central region 38 which is roughly coincident with pad center 24; a second, inner region 40 surrounding first region 38, a third, middle region 42 surrounding second region 40; a fourth, outer region 44 surrounding third region 42, and a fifth, outermost region 46 surrounding region 44. Although generally circular, regions 38–46 are each defined by sixteen-sided perimeters formed of generally straight junctures 48, 50, 52 and 54. Fifth region 46 is also defined by an outer perimeter 56 of housing 12. Junctures 48–54 and outer perimeter 56 extend all the way around front surface 20 of housing 12 across all raised and recessed portions 14, 16. Housing 12 is typically about 7¾-inches in diameter, and thus surface 20, if viewed as a flat face, presents an area of about 24-square-inches, but may be made larger or smaller.

Pad center 24 and each pad arm 22*a–h* include jointed segments generally conforming to concentric regions 38–46 of housing 12. Pad center 24 is the first segment. The remaining segments and joints are indicated in FIG. 1 for arm 22*c* and in FIG. 2 for arm 22*f*, and it will be understood that each arm has the equivalent segments and joints. Joint 58 surrounds pad center 24 and couples it to segment 60. Joint 62 couples the outer edge of segment 60 to segment 64. Joint 66 couples the outer edge of segment 64 to segment 68. Joint 70 couples the outer edge of segment 68 to segment 72, an outer edge 74 of which defines the outer edge of each pad arm when pad 18 is assembled to housing 12. The joints between the segments of the pad preferably are formed by "live hinges" which are cut-out or compressed scores or lines that allow the pad to flex at the hinge, but alternatively may be formed by any suitable means.

Figure 2:
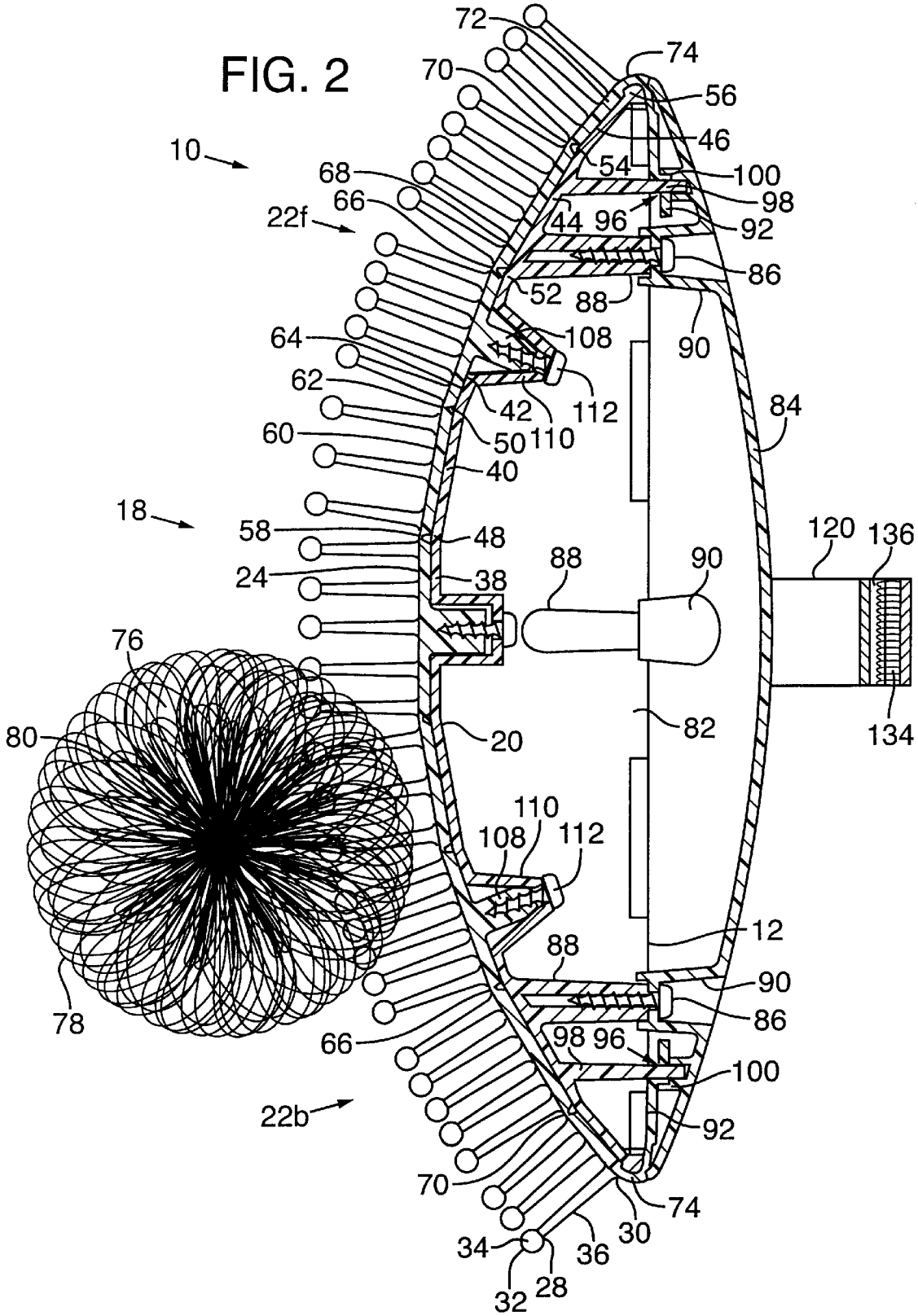
FIG. 2 is a cross-sectional, side view of the catching device of FIG. 1 and a throwing toy having a generally ball-like shape as the toy is just coming into contact with the bristles of the catching device, showing the base of the device being formed of front and rear molded plastic halves joined by screws and the pad arms joined to the front half by screws and having tail ends that loop around the edge of the front half and are captured by a rearwardly-extending spike of the front half.

FIG. 2 shows how the regions and junctures of housing 12 are generally lined up or coincident with the segments and joints of pad center 24 and pad arms 22*a–h* (pad arms 22*b* and 22*f* in FIG. 2 representing all of the pad arms). Outer surface 20 of housing 12 is generally convex because concentric regions 38–46 of housing 12 are joined in an angled relationship. Using central region 38 as a common reference line,. second region 40 is at about 10° with respect to central region 38, third region 42 is at about 20°, fourth region 44 is at about 30°, and fifth region 46 is at about 40°, thus forming the generally convex outer face. The generally convex face is preferably formed with the abruptly angled regions to simplify mold construction, but alternatively could be formed by a continuous curve.

Pad arms 22*a–h* generally nestle in recessed portions 16 between raised portions 14 (FIGS. 1 and 3) and each segment of the pad arms is generally parallel to the underlying region of the housing. Pad 18 is typically about 0.08-inches thick. The "live hinge" joints 58, 62, 66, 70 allow the pad arms to conform to generally convex outer face 12. Pad 18 is preferably molded of a flexible and resilient material such as polypropylene or polyethylene in a single piece with bristles 28, but without forming bristle heads 36.

Each bristle 28 is at least about ¼-inch long from the proximal end at the pad to the distal end opposite, and preferably is about 0.9-inches long, and other lengths may be used. Bristles 28 are preferably about 0.1-inches wide at the proximal end, tapering to about 0.061-inches wide at the distal end, prior to installation of head 36. Heads 36 are preferably applied to the bristles by dipping the distal ends of bristles 28 in epoxy to form heads 36 of at least about 1/16-inch in diameter and preferably about ⅛-inch in diameter. Heads 36 and bristles 28 alternatively may be molded in a single piece with the mold seams parallel to the long axis of the bristles which requires forming the arms with single rows of bristles.

Bristles 28 extend generally perpendicularly from each segment where the bristles are mounted and bristles 28 are preferably generally all of equal length, but alternatively may be of varying lengths. Thus, the distal ends of the bristles present a generally convex array. As best seen in FIG. 1, the recessed portions are larger than the raised portions and the bristle array covers all of the recessed portions and thus the array of bristles covers more than half, but substantially less than all, of the surface area of the outer face of housing 12. As shown in FIG. 2, the bristles are generally parallel to bristles on the same segment but are splayed apart relative to bristles on other segments so that the distal ends of bristles on different segments are generally farther apart than the proximal ends of the bristles.

Figure 3:
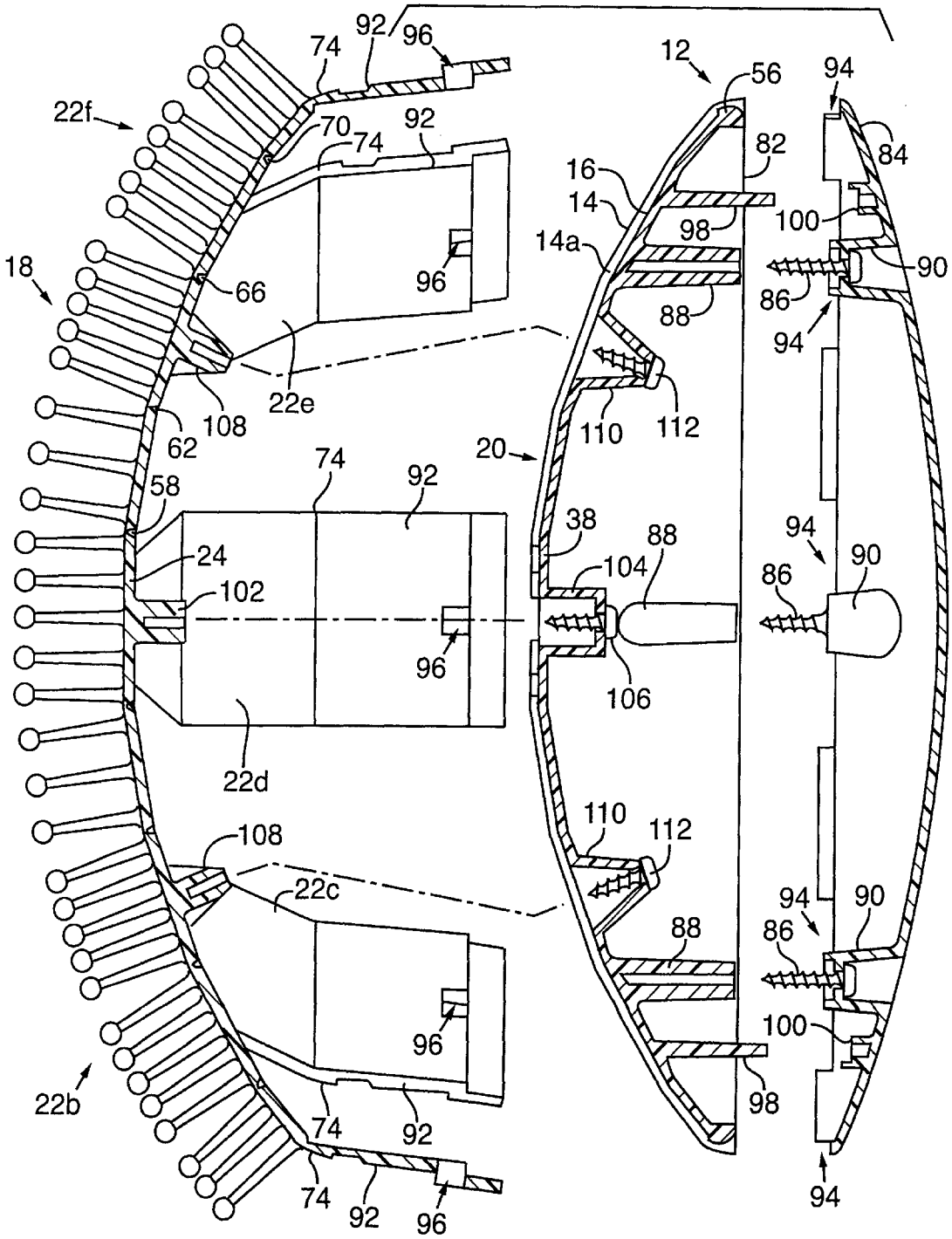
FIG. 3 is an exploded cross-sectional view of the catching device showing the pad arms and a recess in the front half of the base where the pad arms nestle in complete assembly, and showing the rear half of the base.

As best seen in FIG. 3, housing 12 is formed of a front half 82 and a rear half 84, both molded of plastic and joined by four screws 86 (three shown) at four bosses 88 (three shown) in front half 82 and four mating wells 90 in rear half 84. (The fourth screw, boss, and well combination is disposed in the portion of housing 12 which is cut away for the view of FIG. 2.) Housing 12 may alternatively be formed as a single piece or halves 82, 84 may be joined by other suitable means such as rivets, adhesives, or sonic welding.

Each of pad arms 22*a–h* include a tail 92 which extends beyond outer edge 74 of the pad arms, wraps around the outer perimeter 56 of housing 12, is inserted through one of eight slots 94 in rear half 84, and is trapped between the front and rear halves in the complete assembly. Each of tails 92 includes a through-hole 96 which, in the complete assembly, is captured by one of eight spikes 98 which mate with eight bosses 100 on rear half 84, further securing the front and rear halves. In FIGS. 2 and 3 only two of the five spike-boss combinations that would be visible are shown, but it will be understood that the other three spike-boss combinations are positioned on housing 12 to mate with tail slots 96 of pad arms 22*c*, 22*d*, and 22*e* which are shown in FIG. 3. It will also be understood that three more spike boss combinations are positioned on housing 12 to mate with pad arms 22*g*, 22*h*, and 22*a* which are cut away in the view of FIG. 3.

Pad 18 is further affixed to housing 12 at pad center 24 by a boss 102 on pad center 24 which mates with a well 104 in housing central segment 38. A screw 106 secures boss 102 in well 104. Each of the pad arms 22*a–h* includes a rhomboidal boss 108 secured in one of eight mating wells 110 in housing front half 82 by one of eight screws 112. Alternatively, housing 12 and pad 18 may be joined by any suitable means such as rivets, adhesives, or sonic welding.

Figure 5:
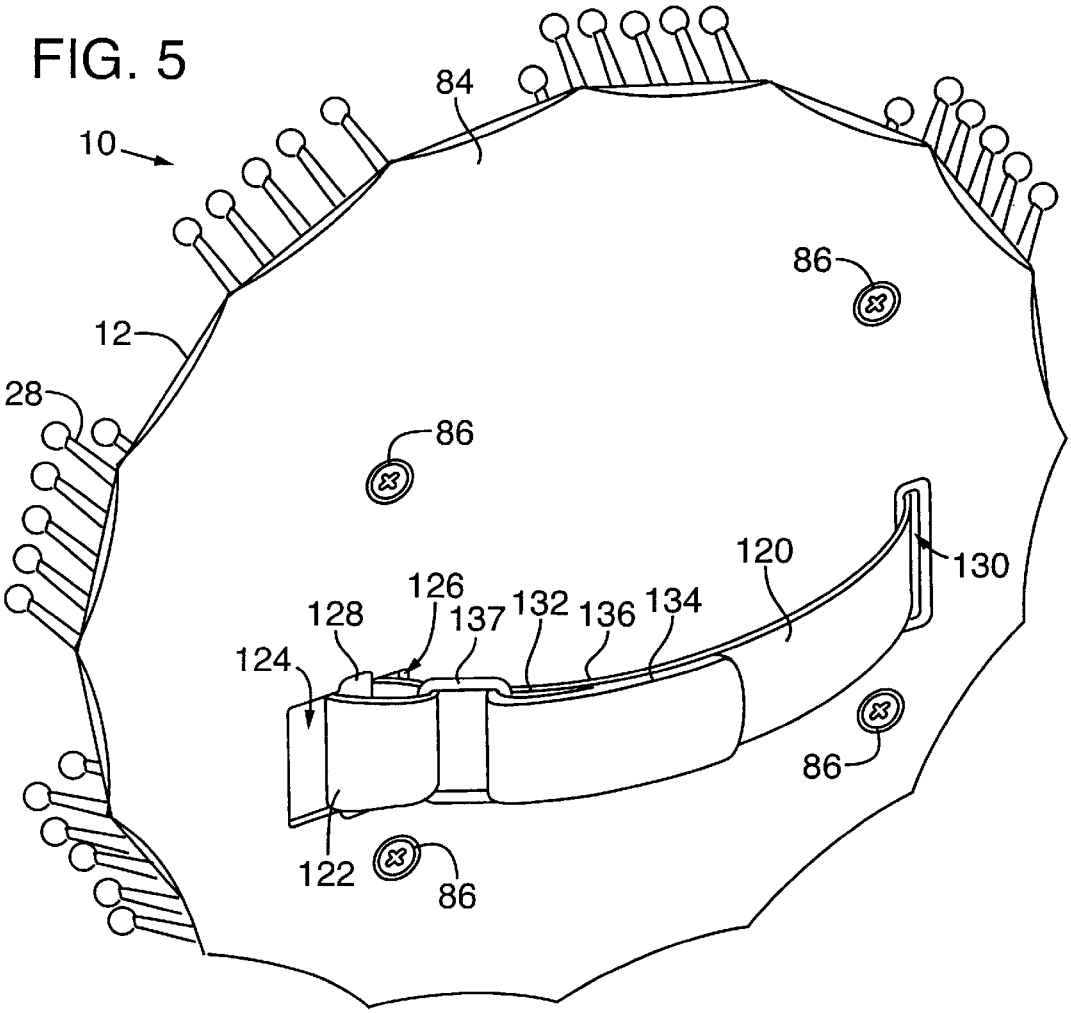
FIG. 5 is an isometric rear view of the catching device showing the screws attaching the rear half of the base to the front half, an adjustable, hook-and-loop-fastenable strap for attaching the device to the user's hand, and the outermost bristles of five of the pad arms.
Figure 6:
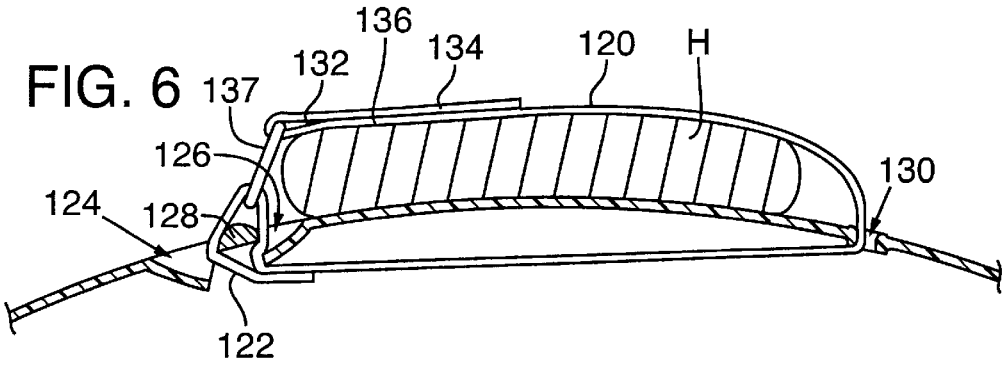
FIG. 6 is a cross-sectional view of the rear half of the base of the catching device showing a user's hand captured in the adjustable strap, thus holding the catching device on the user's hand.

As shown in FIGS. 5 and 6, rear half 84 of housing 12 includes a grasping aid, such as an adjustable hand strap 120 with a first looped end 122 fixed in a pair of slots 124, 126 and around a bridge 128 interposing slots 124, 126. Strap 120 extends from looped end 122 within housing 12 and out through a slot 130. A free end 132 of strap 120 includes hook and loop fasteners 134, 136 adjacent a D-ring 137 through which strap 120 can be adjusted to a desired fit on a user's hand H, or alternatively, the user's wrist, arm, or leg. Any other suitable grasping aid for holding device 10 may be used, such as an attached glove, a handle, or ribs. Thus, housing 12 is configured to be held adjacent a user's hand.

A throwing toy 76 according to the present invention preferably is generally shaped like a ball, as shown in FIG. 2. Toy 76 is formed of a large number of looped elastic filaments 78 which radiate outwardly in a dense bushy configuration from a central core region 80. Preferably between about six and about fifteen filaments, each having a length many times the diameter of the toy, are looped repeatedly and bound together at the core region to form the dense, bushy, ball-shaped configuration of the toy. The diameter of toy 76 is typically about 3- to 5-inches and preferably about 3.5-inches, so toy 76 has a radial dimension RD from a central point in the middle of core region 80 to an outer edge of the filaments of about 1.5- to 2.5-inches (see FIG. 16). Toy 76 may alternatively be formed with a larger or smaller diameter. Bristles 28, as noted above, are at least about ¼-inch in length and preferably are about 0.9-inches long, and thus have a length at least about 10%, and preferably about 36%, of the radial dimension of the toy.

Figure 16:
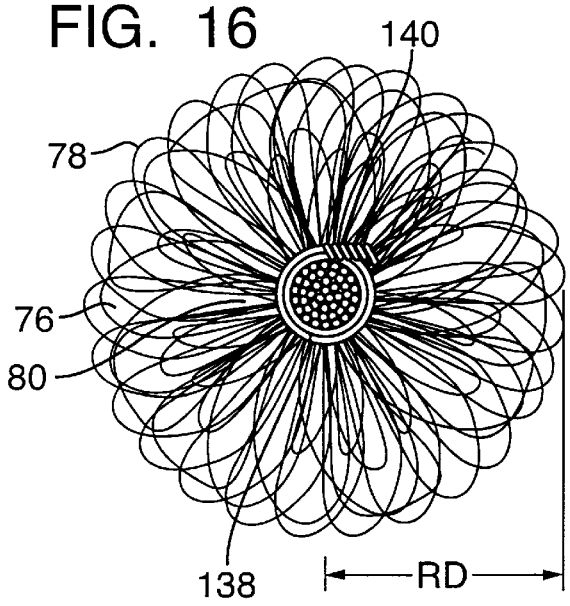
FIG. 16 is a cross-sectional view of a throwing toy having a ball-shape, and showing a wire cinch which is drawn and tightened around the center of the looped filaments to form the center of the toy, the cinch having two ends twisted about one another to secure the cinch.

As shown in cross-section in FIG. 16, toy 76 is formed of flexible, elastic, thin, looped filaments 78 which are joined at the center of core region 80 by a wire cinch 138 which is looped twice around filaments 78. Two ends 140 of wire cinch 138 are twisted together and pressed down in close proximity to the looped portion of the wire, thus securing the cinch and binding the filaments together in the core region. Toy 76 may be formed in accordance with the method described in U.S. Pat. No. 4,756,529 which is incorporated herein by reference. Toy 76 is shown with the looped filaments generally all having an equal length out to the outer ends, but alternatively toy 76 could be formed with the filaments having widely varying lengths out to the outer ends.

FIG. 2 shows toy 76 just as it comes into contact with bristles 28 after being thrown at device 10 by a user. Bristles 28 are configured to catch toy 76 by engaging the looped filaments of the toy, as will be discussed in more detail below. The engaging of the looped filaments occurs for any relative motion of toy 76 and device 10 resulting in contact between toy 76 and device 10, whether toy 76, device 10, or both are moved.

Bristles 28 are configured to cooperate with toy 76 to dissipate the kinetic energy of throwing or dropping the toy, thus to prevent the toy from bouncing off the catching device. As toy 76 strikes catching device 10, filaments 78 collide at a large number of points with heads 34 of typically about thirty to fifty bristles 28 and the outer ends of filaments 78 begin to collapse and/or frictionally to slide by heads 34 and to begin intertwining around the bristles. The collapsing and frictional sliding of the filaments initially dissipates some of the kinetic energy of toy 76. As toy 76 continues to travel into bristles 28, more of filaments 78 collide with bristles 28, continuing absorption of kinetic energy until core region 80 collides with bristles 28. At the same time, the intertwining of the filaments around the bristles continues with at least a portion of the filaments extending around and being engaged by two or more bristles and with filaments radiating outwardly from core region 80 towards opposite sides of the toy extending around bristles spatially separated on the catching device.

The bristles are preferably of sufficient length substantially to prevent the toy from directly impacting, or rebounding from, the outer face of housing 12. Core region 78 is massive enough to cause the flexible bristles to bend slightly, further dissipating, but also storing some of the remaining kinetic energy. The core region then compresses temporarily against the bristles and then expands while the bristles bend back to nominal positions, which tends to cause toy 76 to rebound from device 10. However, the force of the rebound is greatly attenuated due to the absorption of kinetic energy and the force is widely dispersed due to the complexity of the collisions between the filaments in the core region and the distal ends of the bristles. That is, only a small number of filaments collide directly with the bristles while most strike the bristles in a glancing manner which tends to send the force of the rebound off to the sides. Furthermore, by the time the rebound begins to occur, the filaments at the outer edge of the toy have already looped securely around one or more bristles, as described above and as will be discussed below in more detail, and this secures the toy to the catching device and prevents the rebound force from causing the toy to disengage. As a result, the bristles hold the toy when thrown directly at the device even at a high velocity, at least to the maximum velocity that an average adult can impart to the toy, and likely for higher velocities as well.

The bristles are also highly effective at securing the toy when it strikes the device at a low grazing angle, even at 0°, because, in such an impact, the outer filaments of the toy tend to snag on the bristles as the toy passes close over them. Once the initial snagging occurs, the toy tends to be rotated on an axis having a vertex at the snagged filament-bristle combinations and the forward portion of the toy moves down toward the bristles. As this rotation occurs, the first-snagged filaments to the rear are stretching, and the rotation causes filaments on a forward edge of the ball to be snagged in the bristles. As the first-snagged filaments begin to contract and rotate the toy in a reverse direction, the forward filaments hold onto the bristles and prevent disengagement of the toy.

The successful capture of the toy in a low grazing impact depends on: the proximity of the toy's flight path to the bristles, which determines how many filaments will be initially snagged; the velocity of the toy; and the proximity of the point of initial impact to the outer perimeter of the device. In a low grazing angle, low speed impact not at the edge of the device, the toy will be captured if as few as one or two filaments are initially snagged. As the velocity is increased, the toy will be captured only if an increasing number of filaments are initially snagged. When the toy impacts the device near its outer perimeter at a high velocity and only a few filaments are snagged, the toy may slip around the edge of the device and not be captured. Nonetheless the device is capable of catching the toy at a grazing angle of 0° for most impacts.

Figure 4:
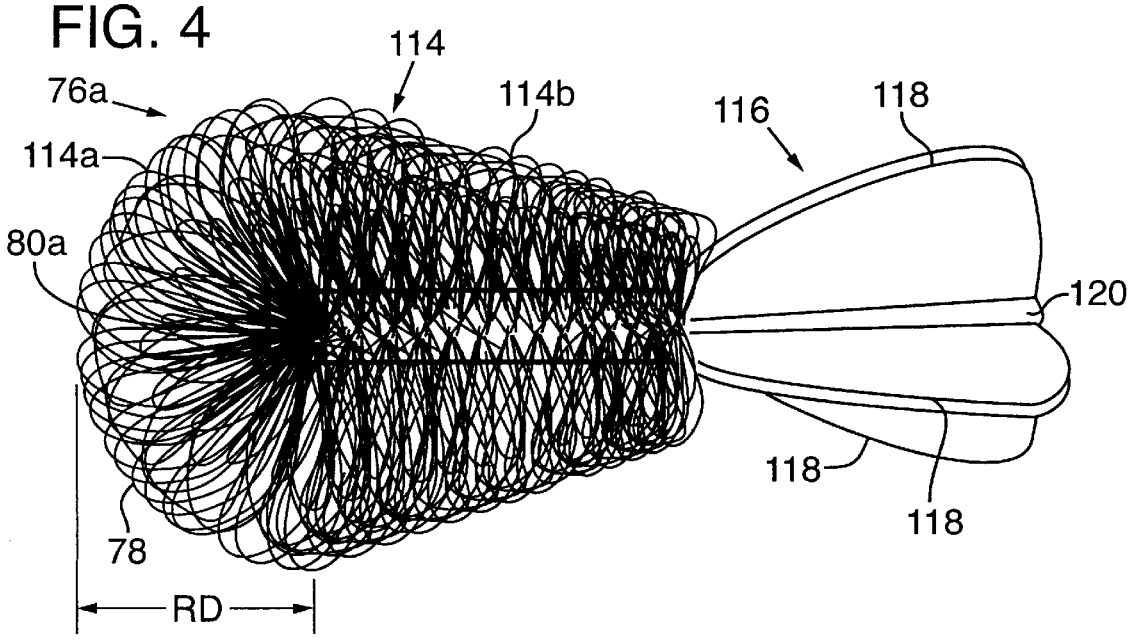
FIG. 4 is a side view of a throwing toy in an alternative embodiment having generally the shape of a dart or rocket with a generally cylindrical, rearwardly-tapering head of elastic, looped filaments and a finned tail section aft of the head.

FIG. 4 shows an alternative embodiment 76*a* of the throwing toy, which has a head 114 made of flexible, elastic, looped filaments 78 which radiate outwardly in a dense bushy configuration from a core region 80*a*. Head 114 has a generally hemispherical front end 114*a* and a generally elongate, roughly cylindrical rear end 114*b* which tapers inwardly towards the rear. Core region 80*a* is elongate and extends roughly along the central axis of rear end 114*b* of head 114. A tail section 116, including three roughly triangular fins 118 affixed to, and extending radially from a central shaft 120, is attached to head 114. Preferably, head 114 is heavier than tail 116, while tail 116 provides an aerodynamic surface, so that toy 76*a*, when thrown, tends to travel and strike catching device 10 headfirst. The radial dimension of interest of toy 76*a* thus extends from a central point at the front of core region 80*a* through front end 114*a* to an outer front edge of the filaments as shown at RD in FIG. 4. Radial dimension RD of toy 76*a* is preferably about 1.5- to 2.5-inches as for the preferred embodiment. The toy may be formed in any shape that permits an outer surface of the toy to present a material that can be engaged by the bristles of device 10. The dimension of the toy may be varied below and above the preferred and alternative embodiments, and device 10 may likewise be varied in size to cooperate with the toy.

FIGS. 7–15 all show toy 76 schematically with one or two filaments 78 and a ball 80 representing the core region in order to illustrate the modes in which the bristles retain the toy on the catching device. FIGS. 7–9 show a first mode of the bristles' capturing the looped filaments wherein, as the toy comes into contact with the catching device, a filament 78 loops over two or more bristles 28 (FIG. 7). When the toy rebounds and/or sags from the catching device, filament 78 is frictionally held by heads 34 of bristles 28, resisting disengagement of toy 76 (FIG. 8). When the toy is pulled away from the catching device, as by being grasped by the user and pulled away from the device, filament 78 stretches and bristles 28 bend until the frictional hold of head 34 on filament 78 is overcome and the toy is pulled away from the bristles.

FIGS. 10 and 11 show a second mode of the bristles' capturing two filaments 78 wherein, as the toy comes into contact with the bristles, two filaments 78 loop over two spatially separated bristles 28 (FIG. 10). When the toy rebounds and/or sags from the catching device, filaments 78 are frictionally held by heads 34 of bristles 28 in a manner similar to the first mode, resisting disengagement of toy 76 (FIG. 11). In any contact between the toy and the bristles, a large number of looped filaments will engage in the first or the second mode, thereby ensuring that the toy is securely retained by the bristles.

FIGS. 12 and 13 show a variation on the first mode of capture when one of the filaments 78 is captured by bristles that are relatively splayed apart because they extend perpendicularly from segments of the catching device that are joined in an angled relationship, as described above. In this case, the strength of the frictional hold of heads 34 on filament 78 is increased because stalks 36 of bristles 28 also provide a frictional hold on filament 78 that resists movement of filament 78 away from the catching device. FIGS. 14 and 15 show that the frictional hold of stalks 36 on filament 78 will resist disengagement of toy 76 even if the heads are eliminated from bristles 28.

Catching device 10 can also be strapped to a user's foot, leg, arm, or body, and the shape of device 10 and the grasping aid may be modified from that shown in the figures to adapt it for connection to other body parts or to other objects. For example, catching device 10 may be configured as a target, in which case it may be desirable to adapt it for attachment to a user's torso, a post, or a wall by suitable means. Catching device 10 may also be without attachment to another object.

While the present invention has been shown and described with reference to the foregoing operational principals and preferred and alternative embodiments, it will be apparent to those skilled in the art that other changes in form and detail may be made therein without departing from the spirit and scope of the invention as defined in the appended claims. It will be understood that the specific embodiments disclosed and illustrated herein are not to be considered in a limiting sense as numerous variations are possible and that no single feature, function or property of the preferred embodiment is essential. The invention is to be defined only by the scope of the claims.

We claim:

1. A system for enhancing games involving throwing and receiving, the system comprising:

a throwing toy including a core region and a multiplicity of flexible, looped filaments radiating outwardly from the core region; and a catching device having a front surface and a plurality of outwardly extending, elongate bristles having a proximal end adjacent the front surface and a distal end opposite the proximal end, wherein at least a portion of the bristles are substantially straight from the proximal end to the distal end, and wherein the looped filaments of the throwing toy are configured to intertwine around the bristles with at least a portion of the looped filaments extending around and being engaged by two or more bristles, the bristles configured to retain the throwing toy on the catching device.

2. A system for enhancing games involving throwing and receiving, the system comprising:

a throwing toy including a core region and a multiplicity of flexible, looped filaments radiating outwardly from the core region; and a catching device having a plurality of outwardly extending, elongate bristles, wherein the looped filaments of the throwing toy are configured to intertwine around the bristles with at least a portion of the looped filaments extending around and being engaged by two or more bristles, the bristles configured to retain the throwing toy on the catching device, and wherein each bristle has a proximal end adjacent the catching device and a distal end opposite the proximal end, and wherein at least one of the bristles is splayed apart relative to at least one other bristle so that the distal ends of the two bristles are generally farther apart than the proximal ends of the bristles.

3. A system for enhancing games involving throwing and receiving, the system comprising:

a throwing toy including a core region and a multiplicity of flexible looped filaments, each filament having an outer end, the toy having a radial dimension defined from the center of the core region to the outer ends of the looped filaments; and a catching device having a plurality of outwardly extending, elongate bristles each having a distal end and a proximal end, the bristles defining a length from the distal end to the proximal end, wherein the bristles are configured to engage the looped filaments to retain the throwing toy on the catching device, and wherein the length of at least a portion of the bristles is at least about 10% of the radial dimension of the throwing toy.

4. The system of claim 3 wherein the length of at least a portion of the bristles is at least about ¼-inch.

5. The system of claim 3 wherein the radial dimension of the toy is less than about 2.5-inches.

6. The system of claim 3 wherein the catching device includes a front surface and the bristles extend from the surface, the surface presenting an area of at least about 15-square-inches.

7. The system of claim 3 wherein at least a portion of the bristles are substantially straight from the distal end to the proximal end.

8. The system of claim 3 wherein at least a portion of the bristles include a generally enlarged head adjacent the distal end to engage the looped filaments of the throwing toy.

9. A system for enhancing games involving throwing and receiving, the system comprising:

a throwing toy including a core region and a multiplicity of flexible looped filaments radiating outwardly from the core region, wherein the filament of the throwing toy each have an outer end, the toy having a radial dimension defined from the center of the core region to the outer ends of the looped filaments; and a catching device having a plurality of outwardly extending, elongate bristles, wherein the bristles are configured to engage the looped filaments to retain the throwing toy on the catching device, the bristles covering at least a portion of the catching device at a concentration of less than about 100 bristles per square inch, and wherein the bristles of the catching device each have a distal end and a proximal end, the bristles defining a length from the distal end to the proximal end, and wherein the length of at least a portion of the bristles is at least about 10% of the radial dimension of the throwing toy.

10. A system for enhancing games involving throwing and receiving, the system comprising:

a throwing toy including a core region and a multiplicity of flexible looped filaments; and a catching device having a plurality of outwardly extending, elongate bristles each having a distal end and a proximal end, at least a portion of the bristles having an enlargement on the proximal end, wherein the enlarged ends of the bristles are configured to engage the looped filaments to retain the throwing toy on the catching device.

11. The system of claim 10 wherein the catching device further includes a strap for attaching the device to a user's hand.

12. The system of claim 10 wherein the catching device includes a generally convex front surface, and wherein the bristles extend from adjacent the front surface.

13. The system of claim 12 wherein the bristles extend generally perpendicularly from adjacent the front surface.

14. The system of claim 12 wherein the generally convex front surface includes a plurality of concentric segments, the segments joined in angled relationship to form the generally convex front surface.

15. The system of claim 10 wherein the catching device has a front surface, the bristles extending from adjacent the front surface, wherein the front surface presents an area of at least about 15-square-inches.

16. The system of claim 10 wherein the catching device has a front surface and a pad coupled to the front surface, and wherein the bristles are attached to the pad.

* * * * *